US008871040B2

(12) United States Patent
Du Plessis et al.

(10) Patent No.: US 8,871,040 B2
(45) Date of Patent: Oct. 28, 2014

(54) HIGH BALLISTIC STRENGTH MARTENSITIC ARMOUR STEEL ALLOY

(75) Inventors: Deon Francoise Du Plessis, Krugersdorp (ZA); Jacob Johannes Wessels, Secunda (ZA); Percy Phillip Adams, Parkwood (ZA); Roelof Johannes Mostert, Wierda Park (ZA); Waldo Edmund Stumpf, Groenkloof (ZA)

(73) Assignee: Damascus Armour Development (Pty) Ltd., Secunda (ZA)

( * ) Notice: Subject to any disclaimer, the term of this patent is extended or adjusted under 35 U.S.C. 154(b) by 0 days.

(21) Appl. No.: 13/378,271

(22) PCT Filed: Jun. 15, 2010

(86) PCT No.: PCT/IB2010/052675

§ 371 (c)(1), (2), (4) Date: Mar. 5, 2012

(87) PCT Pub. No.: WO2010/146535

PCT Pub. Date: Dec. 23, 2010

(65) Prior Publication Data

US 2012/0144989 A1 Jun. 14, 2012

(30) Foreign Application Priority Data

Jun. 15, 2009 (ZA) ..... 2009/04177

(51) Int. Cl.

| | |
|---|---|
| ***C22C 38/04*** | (2006.01) |
| ***C22C 38/44*** | (2006.01) |
| ***C22C 38/38*** | (2006.01) |
| ***C22C 38/58*** | (2006.01) |
| ***C21D 8/02*** | (2006.01) |
| ***C21D 9/10*** | (2006.01) |

(52) U.S. Cl.
USPC ..... 148/335; 148/320; 420/120; 420/108; 89/36.02

(58) Field of Classification Search
USPC ..... 148/320, 335, 654; 420/108
See application file for complete search history.

(56) References Cited

U.S. PATENT DOCUMENTS

| | | | | |
|---|---|---|---|---|
| 4,170,497 | A * | 10/1979 | Thomas et al. | 148/333 |
| 4,671,827 | A * | 6/1987 | Thomas et al. | 148/609 |
| 2012/0174749 | A1 * | 7/2012 | Stumpf et al. | 89/36.02 |

FOREIGN PATENT DOCUMENTS

| | | |
|---|---|---|
| CZ | 291 146 | 12/2002 |
| DE | 102 20 476 | 11/2003 |
| EP | 0 731 332 | 9/1996 |
| GB | 29597 | 0/1910 |

OTHER PUBLICATIONS

International Search Report for PCT/IB2010/052675, mailed Feb. 7, 2011.

* cited by examiner

*Primary Examiner* — Deborah Yee
(74) *Attorney, Agent, or Firm* — Nixon & Vanderhye PC

(57) ABSTRACT

The invention relates to an air hardenable high-hardness steel for armoring applications, such as armor plate for use in light armored vehicles and body armor, and having a high level of ballistic performance relative to its plate thickness. In particular, the invention concerns a high ballistic strength martensitic armor steel which, in an air cooled and untempered condition, has a strength coefficient (s0) of higher than 2500 MPa; a flow parameter (P) of higher than 8.0, preferably higher than 18.0; and a manganese content of 1.8 to 3.6% by weight of manganese, preferably 2.8 to 3.1% by weight of manganese. The armor steel also includes retained austenite at a volume fraction of at least 1%, and preferably a volume fraction of 4 to 20%.

24 Claims, 3 Drawing Sheets

Figure 4B:
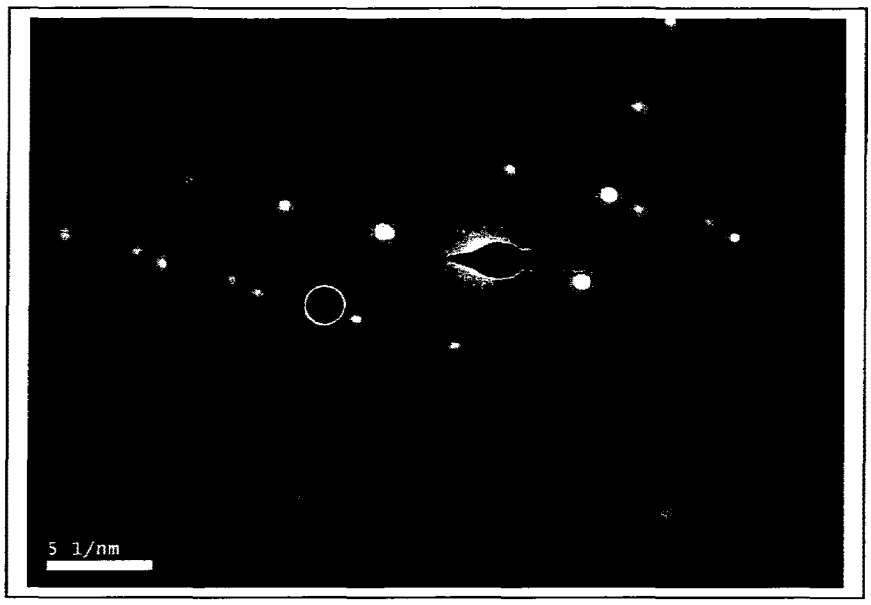

Figure 4a Field Image on TEM

Selected Area Diffraction: [100]M [110]A

Retained austenite

HIGH BALLISTIC STRENGTH MARTENSITIC ARMOUR STEEL ALLOY

This application is the U.S. national phase, under 35 U.S.C. §371, of International Application No. PCT/IB2010/052675, filed 15 Jun. 2010, which claims priority to South Africa Application No. 2009/04177, filed 15 Jun. 2009, the entire contents of each of which are hereby incorporated herein by reference.

INTRODUCTION

The present invention relates to an air hardenable high strength steel alloy for armouring applications, such as armour plate for use in light armoured vehicles and body armour, and having a high level of ballistic performance relative to its plate thickness.

BACKGROUND TO THE INVENTION

Steels for armouring are well known and are generally characterised in having a predominantly tempered martensitic structure. Such martensitic armour steels have high strength and good ballistic performance properties, which enables the steel to resist the impact of a high velocity projectile. Armour steel alloys can have a variety of chemical compositions and through the years military and security specifications have been developed which mostly focused on improving the hardness and impact resistance properties, and also the yield and tensile strength of these various alloys. One of the main thrusts of these developments has been to lower the thickness of the armour plate in order to reduce the mass of armoured vehicles and body armour.

Armour steel plates are generally produced by producing a billet, whether through ingot or continuous casting processes, and then hot rolling the armour steel to a desired plate thickness. The hot rolled steel plates are allowed to cool down to room temperature, after which they are re-heated to approximately 800° C.-900° C. in a process called austenisation, during which the steel acquires a predominantly austenitic microstructure. The steel is then quenched by means of water, oil or platten, and subsequently tempered at approximately 200° C. to improve fracture toughness.

One drawback of this heat treatment process is that it is time consuming and involves significant costs to take the steel through the re-heating, quenching and tempering process steps. Also, advanced manufacturing facilities and equipment, and skilled labourers are necessary to execute the process steps, which further add to manufacturing costs. Moreover, quenching has a tendency to cause distortion of as-rolled armour steel plates if not executed under strictly controlled conditions.

Hitherto is has not been customary to produce armour steel by means of air-cooling alone. If known armour steel alloys undergo air-cooling alone after austenisation, ferrite and pearlite often form as normal products of the austenitic microstructure. It will be appreciated that ferrite and pearlite have poor ballistic properties. Therefore, to increase ballistic performance, the steel is normally quenched after austenisation so as to acquire a predominantly martensitic microstructure, which is a significantly harder microstructure, but a structure which unfortunately has poor toughness performance. Hence the subsequent tempering step to increase fracture toughness.

Although not done before, the applicant wanted to develop an air hardenable armour steel alloy with a martensite-residual austenite structure as well as good ballistic properties, by utilising the effect of alloying elements in producing the required structure upon air cooling alone and without the need for tempering. In so doing, armour plate might be developed which represents an improvement as far as cost of production, ballistic resistance and plate mass is concerned. Another significant benefit of this process route would be that wider plates could be produced within existing flatness specifications, since plate flatness is generally better after slow cooling compared to rapid cooling. Through extensive research and development the applicant believes that it is now able to produce a high-hardness steel alloy, suitable for armouring applications, and with increased mechanical and ballistic performance characteristics when compared to competing products on the market, but with the significant difference that it can, in a certain thickness range, be air-cooled only and does not need to be tempered.

SUMMARY OF THE INVENTION

According to the invention there is provided a high ballistic strength martensitic armour steel alloy characterised in that, in the untempered condition, it has a strength coefficient ($s_0$) of higher than 2500 MPa; a flow parameter (P) of higher than 8.0, preferably higher than 18.0; and a manganese content of 1.8 to 3.6% by weight of manganese, preferably 2.8 to 3.1% by weight of manganese.

For the purposes of this specification the flow parameter (P) is defined as $$P=(10*s_0*n)/s_y$$

wherein—

$s_0$ is a strength coefficient;

n is the work hardening exponent referring to a value obtained from applying the Ludwik equation to compression data, at true plastic strains above 1.8 per cent; and $s_y$ is the strength coefficient required to cause 0.03% of true plastic strain.

For thinner armour plate, where plate thickness is in the same order of magnitude as a projectile diameter, a major perforation mechanism is that called "shear plugging". When this mechanism is operative, steel deformation and work is concentrated in a small volume adjacent to the outer diameter of a projectile. For this case, it has been shown that the work required to penetrate a plate with a given thickness ($h_0$) is given by the following equation, demonstrating that a steel with a high strength coefficient ($s_0$—value) will require more work, and hence, higher projectile velocities, to result in perforation.

Work in adiabatic shear failure of a target $$W=pd^2s_0/2.(h_0-v3/2d)+pd^3s_0/(12\tan(\theta/2))$$

wherein— d=projectile diameter $s_0$=strength coefficient (true flow stress at a true strain e=100%)

d=projectile diameter $h_0$=target thickness

θ=cone-included angle of the projectile

Similarly, it has been shown that a high work hardening exponent during plastic flow (n) can be correlated with good ballistic properties.

In the case of an air hardened plate without a subsequent tempering step, high levels of residual stress are detrimental since it can contribute to cracking problems during forming and fabrication operations. In such a case, relatively low yield stress ($s_y$) values will be beneficial, since residual stress levels cannot exceed the steel yield stress. Low yield stress values will furthermore enhance the plastic fracture toughness, as expressed by J-integral values, of the untempered plates with relatively low Charpy properties.

For the amour steel concerned, it was therefore an objective to obtain high strength coefficients and work hardening exponents, while maintaining a low level of yield strength. It was found that these three flow properties could be expressed as a dimensionless single flow parameter (P) wherein $P=(10*s_0*n)/s_y$, with high levels of P being beneficial for the armour plate. The strength coefficient ($s_0$) was determined using high strains in compression testing. The work hardening exponent (n) refers to a value obtained from applying the Ludwik equation to compression data, at true plastic strains above 1.8 per cent and the strength coefficient ($s_0$) was determined in the same strain range and using the same method. All flow values refer to that obtained in quasi-static uni-axial tensile and compression tests.

The martensitic armour steel alloy may be air-cooled and untempered.

The martensitic armour steel alloy also may include retained austenite at a volume fraction of at least 1%, and preferably a volume fraction of 4 to 20%.

In addition to the manganese, the martensitic armour steel alloy may include carbon, silicon, nickel, chromium and molybdenum, with the balance being mostly iron.

In one embodiment of the invention, the martensitic armour steel alloy may be characterised therein that its composition, by weight, in addition to the 1.8 to 3.6% by weight of manganese, preferably 2.8 to 3.1% by weight of manganese, is as follows:

0.29-0.33% of carbon
0.8-1.1% of silicon
3.0-3.6% nickel
1.0-1.2% chromium
0.55-0.70% molybdenum
with the balance being mostly iron.

The martensitic armour steel alloy may have a strength coefficient ($s_0$) of 6400 MPa; a $s_y$ value of 460 MPa; and a P value in the order of 42.

In an alternative embodiment of the invention, the martensitic armour steel alloy may be characterised therein that its composition, by weight, in addition to the 1.8 to 3.6% by weight of manganese, preferably 2.8 to 3.1% by weight of manganese, is as follows:

0.42-0.46% of carbon
1.0-1.3% of silicon
3.0-3.6% nickel
1.2-1.4% chromium
0.55-0.70% molybdenum
with the balance being mostly iron.

The martensitic armour steel alloy further may be characterised therein that it is air-cooled either directly after hot rolling, or alternatively after austenisation, but either way, without undergoing quenching and/or tempering.

According to a further aspect of the invention there is provided an as air-cooled armour steel plate which satisfies the Nato Stanag 4569 Annex A Level 1 requirement for ballistic performance, wherein the plate has a thickness of 7-9 mm, and preferably a thickness of 8 mm, and the following composition, by weight:

2.8-3.1% of manganese
0.29-0.33% of carbon
0.8-1.3% of silicon
3.0-3.6% nickel
1.0-1.2% chromium
0.55-0.70% molybdenum
with the balance being mostly iron.

According to a further aspect of the invention there is provided an as air-cooled armour steel plate which satisfies the Nato Stanag 4569 Annex A Level 1 requirement for ballistic performance, wherein the plate has a thickness of 6-8 mm, and preferably a thickness of 7 mm, and the following composition, by weight:

2.8-3.1% of manganese
0.42-0.46% of carbon
1.0-1.3% of silicon
3.0-3.6% nickel
1.2-1.4% chromium
0.55-0.70% molybdenum
with the balance being mostly iron.

According to yet a further aspect of the invention there is provided a quenched and tempered armour steel plate which satisfies the Nato Stanag 4569 Annex A Level 1 requirement for ballistic performance, wherein the plate has a thickness of 5-7 mm, and preferably a thickness of 6 mm, and the following composition, by weight:

2.8-3.1% of manganese
0.42-0.46% of carbon
1.0-1.3% of silicon
3.0-3.6% nickel
1.2-1.4% chromium
0.55-0.70% molybdenum
with the balance being mostly iron.

According to yet a further aspect of the invention there is provided an air cooled and tempered armour steel plate which satisfies the Nato Stanag 4569 Annex A Level 1 requirement for ballistic performance, wherein the plate has a thickness of 8-10 mm, preferably a thickness of 9 mm, and the following composition, by weight:

2.6-2.9% of manganese;
0.29-0.33% of carbon;
0.8-1.3% of silicon;
3.0-3.6% nickel;
1.0-1.2% chromium;
0.55-0.70% molybdenum,
with the balance being mostly iron.

By conducting continuous cooling transformation diagrams, quasi static uni-axial tensile and compression tests, as well as ballistic tests, the applicant has come to the conclusion that manganese, and particularly manganese in the range of 1.8 to 3.0% by weight of manganese, and more particularly 2.8 to 3.1% by weight of manganese, in conjunction with the standard alloying elements of carbon, silicon, nickel, chromium and molybdenum, plays a critical role in improving work hardening, energy absorption and ballistic resistance for as-cooled armour plate, especially for imparting resistance of the plate to adiabatic shear plugging failure.

Of all the alloying elements, it was found that manganese was the most cost effective element to simultaneously increase the air hardening ability and reduce Martensite-Start temperature ($M_s$), thereby increasing residual austenite content in the martensitic armour steel alloy. Residual austenite is relatively soft and ductile, and in other steel types, such as sheet steel for motorcars, it has been found that a mixture of hard and soft microstructures resulted in good work hardening and strength properties.

The invention also provides for a method of producing a martensitic armour steel alloy, the method comprising the steps of subjecting a steel alloy, which comprises carbon, silicon, nickel, chromium, molybdenum, iron and 1.8 to 3.6% by weight of manganese, preferably 2.8 to 3.1% by weight of manganese, to hot-rolling from a reheating temperature of between 1000° C. and 1250° C., finish rolling in the order of 900° C. or lower to achieve a fine austenite grain size, and then air cooling the steel to room temperature. The method may include the intermediate step, after hot-rolling, of subjecting the steel to an austenisation heat treatment step at a temperature of 800° C.-900° C., after which the steel is air cooled, or quenched, followed by the optional heat treatment step of tempering.

The invention further extends to body armour inserts and as-rolled thin armour plate comprising the martensitic armour steel alloy of the invention.

SPECIFIC EMBODIMENT OF THE INVENTION

Figure 1:
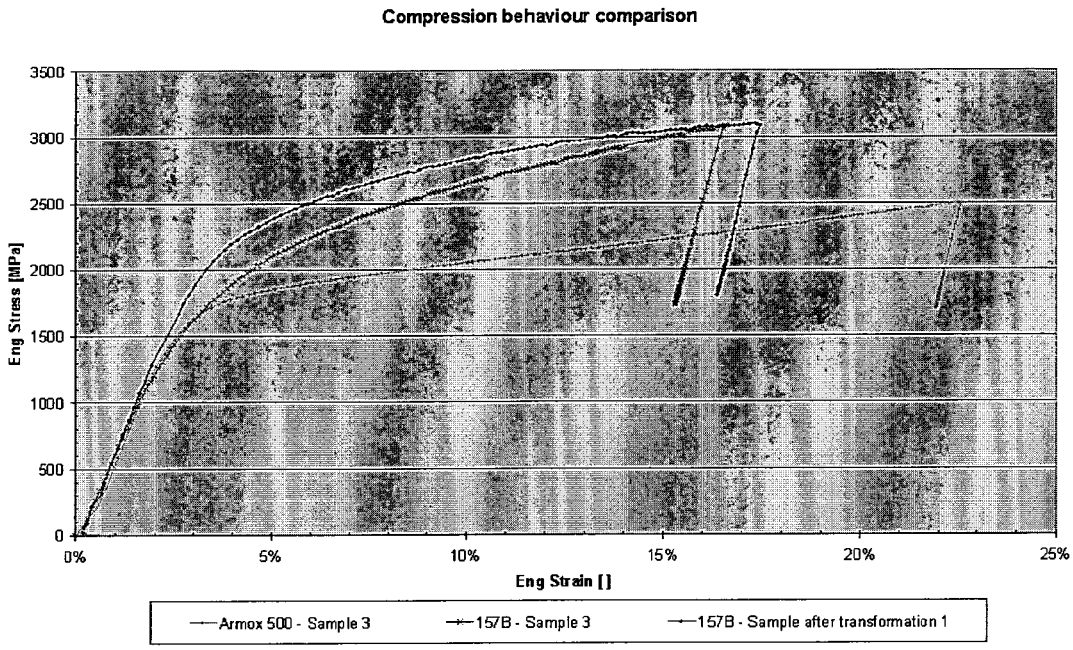

The invention will now further be illustrated and exemplified with reference to the accompanying, non-limiting examples and figures, wherein the figures are:

FIG. 1 A comparison in flow behaviour during compression test, for the experimental alloy #1 and the benchmark Armox 500, up to a total reduction in original cross-section area of about 25%. Note the higher work hardening rate for the experimental alloy.

Figure 2:
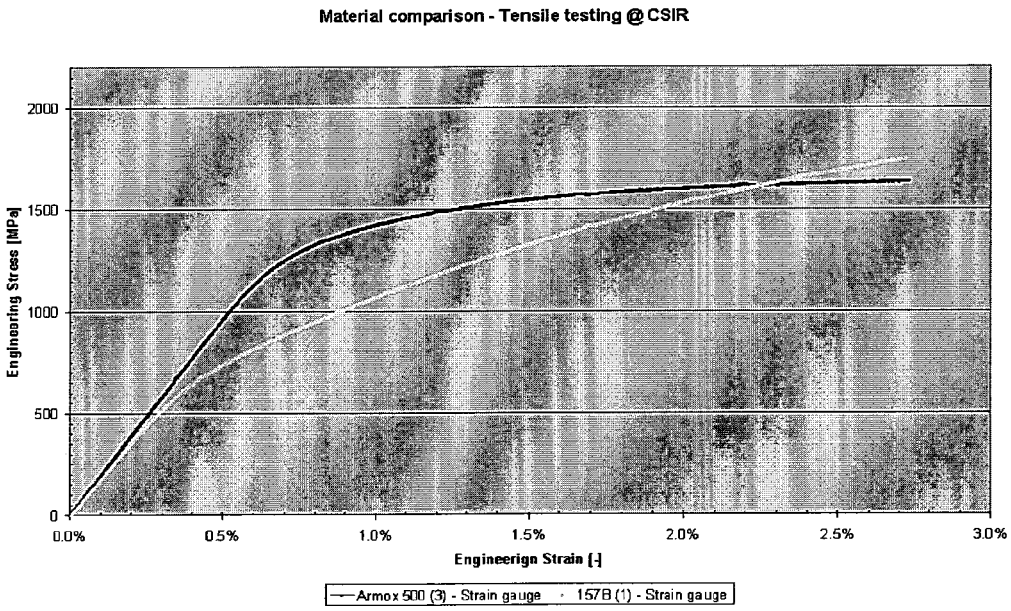

FIG. 2 A comparison in tensile behaviour of the experimental alloy #1 and the benchmark Armox 500, up to a total engineering strain of about 2.8%. Note the lower yield strength and higher work hardening rate for the experimental alloy.

Figure 3:
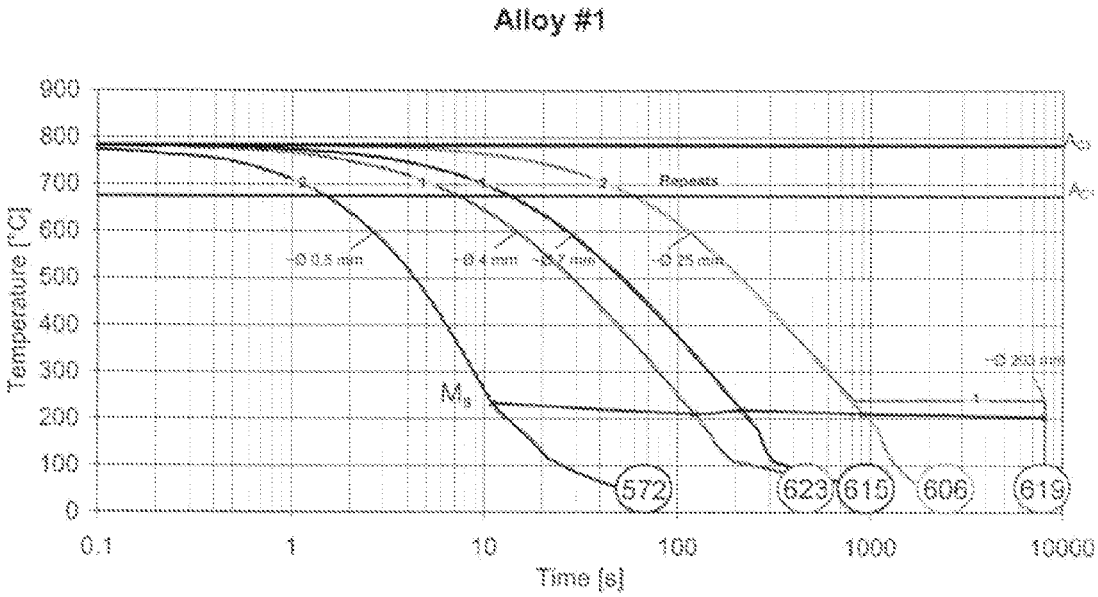
Figure 3:
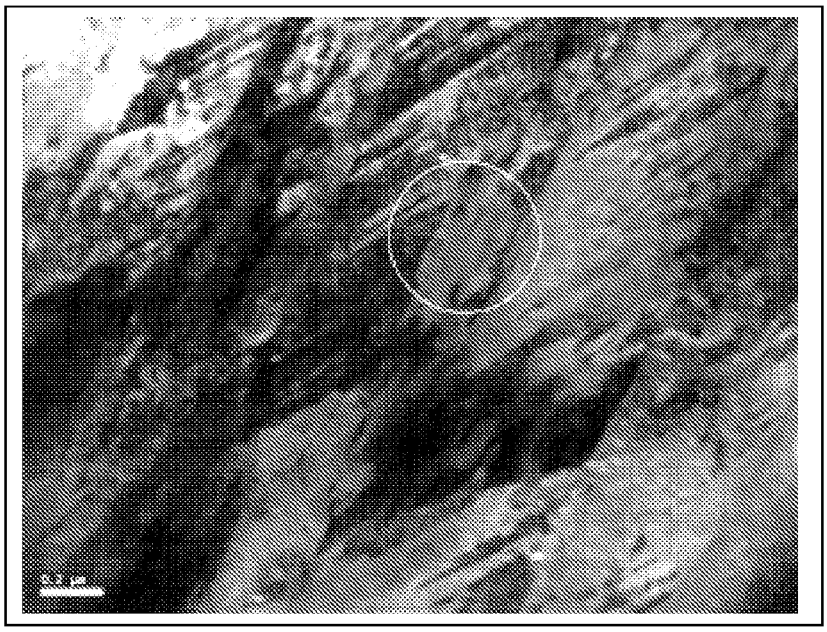

FIG. 3 CCT diagram (provisional) of alloy #1, demonstrating the ability of the alloy to air harden and to form retained austenite (through relatively low $M_s$—temperature).

Figure 4C:
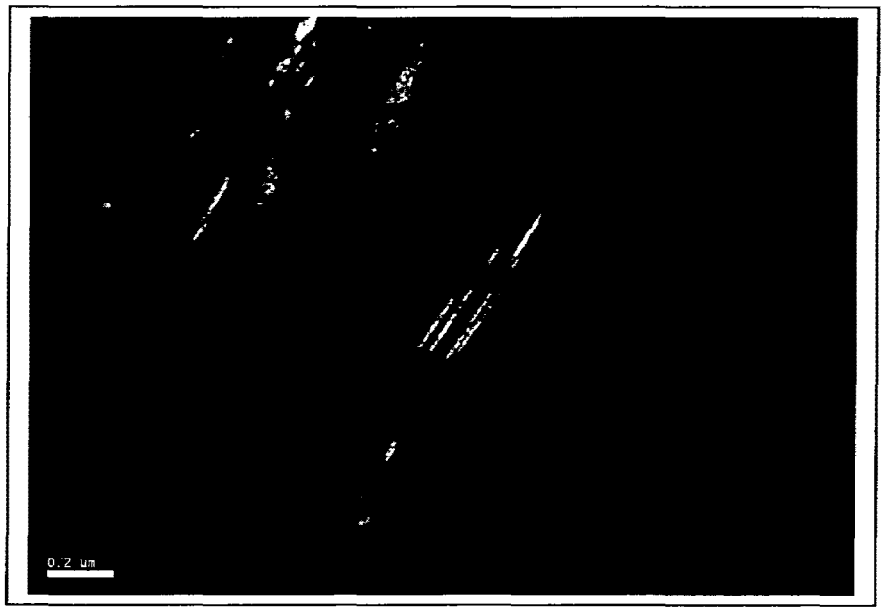

FIG. 4(*a*)-(*c*) Transmission Electron Microscopy micrographs of alloy #5's air cooled microstructure showing a) martensitic matrix, b) diffraction patterns of retained austenite, and c) retained austenite.

(i) The applicant produced two martensitic-austenitic armour steel alloys comprising carbon, silicon, nickel, chromium, molybdenum and iron, and characterised in also comprising 2.9% by weight of manganese. The specific armour steel alloys of the invention are marked as #1 and #5 in Table 1 below. The applicant conducted chemical analyses and ballistic tests on the armour steel of the invention, as well as on other commercially available armour plate grades. The comparative results are detailed in Table 1.

(ii) Moreover, comparative true stress-strain tests between (a) Armox 500 armour plate grade, (b) air-cooled armour steel of alloy #1 composition (as detailed in Table 1 above), and (c) quenched and tempered armour steel of alloy #1 composition, yielded the results as detailed in Table 2.

TABLE 2

| Item | Sample description | Proof Stress, MPa* | Work hardening exponent* | Strength Coefficient, MPa* | Relative Energy Required to Penetrate |
|---|---|---|---|---|---|
| a | Armox 500 | 730 | 0.27 | 3400 | 100 |
| b | Alloy #1, As Air Cooled | 460 | 0.22 | 6400 | 188 |
| c | Alloy #1, Quenched and Tempered | 970 | 0.30 | 2900 | 85** |

*Definition of parameters as defined earlier in this document
**Preliminary results It has been found that the air cooled samples exhibited a marked improvement in plastic flow properties, as illustrated in Table 2 above, when compared to the same sample after quenching and tempering (compare items b and c), and when compared to the benchmark alloy. The excellent work hardening behaviour of alloys #1 and #5 in the air cooled condition and the resultant high levels of strength coefficient values is believed to be one of the main contributors to the good combination of plate thickness and ballistic resistance demonstrated in Table 1.

Table 2 includes the calculated work (both due to indentation and plugging) required to perforate a 7 mm plate of the alloys, based on Woodward's equations (see section earlier in document) by a projectile with a 60 degrees included conical point. Comparatively, for the purpose of relative comparison, the plastic work performed for the benchmark steel (Armox 500, quenched and tempered) was normalized to 100 units. If compared in this fashion, the alloy #1 sample in the as air cooled condition required 188 units of plastic work to achieve the same strain, i.e. 88% more work was expended for this alloy compared to the benchmark. Comparatively, this alloy

TABLE 1

| Type | C | Mn | Si | Ni | Cr | Mo | B | Nominal Hardness/ (Grade) | Plate Thickness required for STANAG* | Steel maker | Heat Treatment Required |
|---|---|---|---|---|---|---|---|---|---|---|---|
| Armox 500 T | 0.32 | 1.2 | 0.1-0.4 | 1.8 | 1.0 | 0.7 | 0.005 | 500 | 9-10 mm | SSAB Oxelösund | Quenched and Tempered |
| Armox 600T | 0.47 | 1.0 | 0.1-0.7 | 3.0 | 1.5 | 0.7 | 0.005 | 650 | 6-7 mm | SSAB Oxelösund | Quenched And tempered |
| Miilux 500 | 0.30 | 1.7 | 0.7 | 0.8 | 1.5 | 0.5 | 0.004 | 500 | 9-10 mm | Rauttaruukki Corporation | Quenched and Tempered |
| Mars 300 | 0.45 0.55 | 0.3 0.7 | 0.6 1.0 | 4.5 | 0.4 | 0.3-0.5 | — | 600 | 6-7 mm** | Arcelor-Mittal | Quenched and Tempered |
| Bisplate HHA | 0.32 | 0.4 | 0.35 | 0.35 | 1.2 | 0.3 | 0.002 | 500 | 10 mm** | Bisaloy Steels | Quenched and Tempered |
| #1 | 0.33 | 2.9 | 1.0 | 3.5 | 1.0 | 0.6 | — | 560 | 7-8 mm | | Air Cool |
| # 5 | 0.46 | 2.9 | 1.3 | 3.5 | 1.4 | 0.6 | — | 600/650 | 6-7 mm | | Air Cool |

*(STANAG 4569 Annex A Level 1-7.62 * 51 mm NATO ball @ 833 m/s $V_{proof}$ and 5.56 * 45 mm M193 @ 937 m/s $V_{proof}$
**Values from literature

#1 sample in the quenched and tempered condition and for the same conditions mentioned above, exhibited a work requirement 15% lower (provisional results) than that of the benchmark, demonstrating the significant benefit of the as-cooled heat treatment process as far as work requirement is concerned.

A dilatometrical investigation demonstrated that the alloys #1 and #5 can, as a result of the specific manganese and other alloy content employed, achieve the required martensite—retained austenite microstructure upon air cooling of large diameter bars, i.e. up to ~100 mm (See FIG. 3). Furthermore, the martensite-start temperature—i.e. 219° C. for alloy #1 and 114° C. for alloy #5—was found to be sufficiently low to produce the required fraction of retained austenite. A microstructural investigation into the fundamental reasons behind this behaviour indicated that the improved plastic work hardening capability of the alloys was partly due to the martensite—retained austenite microstructure (see FIG. 4), and for the as air cooled samples, stabilization of retained austenite during air cooling takes place, leading to higher volumes of retained austenite in the as air cooled case. The microstructure of a martensitic matrix with some retained austenite resulted in a steel with a relatively low elastic limit and, consequently, significant plastic work hardening in its stress-strain graph, as determined with uni-axial quasi-static mechanical tests. During plastic straining the measure by which the material work hardens is then comparatively higher and this behaviour in turn results in more work performed and energy expended for the as air cooled alloy.

This behaviour was demonstrated by performing successive compression tests on samples of alloy #1, one of which contained the normal 6% retained austenite and another which, after a laboratory cryogenic quench, contained a fully martensitic structure (0% retained austenite). The flow curves of the two samples are given in FIG. 1, and demonstrate that the work hardening behaviour of the purely martensitic sample is lower than that of the alloy #1 sample containing 6% retained austenite. It was found that the loss of the retained austenite due to cryogenic quenching resulted in a ~20 per cent lower strength coefficient ($s_0$).

The rapid work hardening behaviour of the experimental alloy #1 was also observed during sensitive uni-axial tensile tests, where a strain gauge was applied to the sample gauge lengths. The results (FIG. 2) demonstrate that the alloy #1, containing the ~6% retained austenite, demonstrates strong plastic work hardening from engineering stress values of ~500 MPa, while the benchmark alloy only shows this behaviour after ~1200 MPa. The comparison also demonstrates that at engineering strains greater than 2.5%, the stress required for further deformation rises to levels above that required for the benchmark.

The retained austenite content of the alloys #1 and #5 has been studied with a number of methods. Transmission Electron Microscopy, with selected area diffraction studies, demonstrated the presence of retained austenite in Alloys #1 and #5, (see FIG. 4), but the technique used cannot quantify the percentage content of this phase. X-ray diffraction tests similarly confirmed the presence of retained austenite, but resulted in great variability from spot to spot, presumably due to microstuctural banding. Cryogenic dilatometry however resulted in repeatable bulk retained austenite values.

Austenite has a face-centred cubic structure that is closely packed. Martensite is a body-centred cubic structure that is not closely packed. If austenite transforms to martensite, the change from a closely packed structure to a structure that is not closely packed, results in a volume expansion. Values for the change in volume during the transformation of a 100% austenite to martensite are available in the literature. This behaviour was used to calculate and compare the amount of residual austenite in a number of the experimental and benchmark alloys. From the data in Table 3 below, the experimental alloy #1 demonstrated a bulk retained austenite percentage of ~6%, while the benchmark alloy contained no retained austenite. The bulk retained austenite content of alloy #5 was similarly determined as being 9% (spot measurements showed up to 20%), while Armox 600 again contained none.

TABLE 3

| Steel/sample | Original length (mm) | Length change, after cryogenic quenching from dilatometry (mm) | Average relative length change (fraction) | Estimated retained austenite content (%) |
|---|---|---|---|---|
| Alloy 1/157B2 | 12.000 | 0.0098 | 0.00088 | 6.2 |
| Alloy 1/157B3 | 12.000 | 0.0105 | | |
| Armox 500/1 | 11.994 | −0.0012 | −0.00007 | −0.5 |
| Armox 500/2 | 11.995 | −0.0009 | | |

Table 3 illustrates an estimate of the amount of residual austenite in four samples, based on measurement of length before and after cryogenic quenching. The volume change on transformation from 100% austenite to martensite, for a steel with a similar carbon content, was taken as 4.2%

The invention claimed is:

1. A high ballistic strength martensitic armour steel alloy characterised in that, in the untempered condition, it has a strength coefficient ($\sigma_0$) of higher than 2500 MPa; a flow parameter (P) of higher than 8.0; a manganese content of 2.9% to 3.6% by weight of manganese; a carbon content of 0.29% to 0.46% by weight of carbon; a balance of iron and unavoidable impurities; and retained austenite at a volume fraction of 6% to 20%.

2. The martensitic armour steel alloy according to claim 1 wherein the alloy is air-cooled and untempered.

3. The martensitic armour steel alloy according to claim 1 wherein the alloy also includes silicon, nickel, chromium and molybdenum, with the balance being iron.

4. The martensitic armour steel alloy according to claim 3 wherein the alloy comprises 0.29% to 0.33% of carbon, by weight, and 0.8-1.1% of silicon;
3.0-3.6% nickel;
1.0-1.2% chromium; and
0.55-0.70% molybdenum,
with the balance being iron.

5. The martensitic armour steel alloy according to claim 3 wherein the alloy comprises 0.42% to 0.46% of carbon, by weight, and 1.0-1.3% of silicon;
3.0-3.6% nickel;
1.2-1.4% chromium;
0.55-0.70% molybdenum,
with the balance being iron.

6. The martensitic armour steel alloy according to claim 2 wherein the alloy is air-cooled either directly after hot rolling, or alternatively after austenisation, but either way, without undergoing quenching and/or tempering.

7. The martensitic armour steel alloy according to claim 1 wherein the alloy has a strength coefficient ($\sigma_0$) of 6400 MPa; a $\sigma_y$ value of 460 MPa; and a P value in the order of 42.

8. An as air-cooled armour steel plate having a thickness of 7-9 mm, a strength coefficient ($\sigma_0$) of higher than 2500 MPa, a flow parameter (P) of higher than 8.0, a manganese content of 2.9% to 3.6% by weight of manganese, and retained austenite at a volume fraction of 6% to 20%, and an alloy composition of: 0.29-0.33% of carbon, by weight, and 0.8-1.1% of silicon;
3.0-3.6% nickel;
1.0-1.2% chromium;
0.55-0.70% molybdenum,
with the balance being iron.

9. An as air-cooled armour steel plate having a thickness of 6-8 mm, a strength coefficient ($\sigma_0$) of higher than 2500 MPa, a flow parameter (P) of higher than 8.0, a manganese content of 2.9% to 3.6% by weight of manganese, and retained austenite at a volume fraction of 6% to 20%, and an alloy composition of: 0.42% to 0.46% of carbon, by weight, and 1.0-1.3% of silicon;
3.0-3.6% nickel;
1.2-1.4% chromium;
0.55-0.70% molybdenum,
with the balance being iron.

10. A quenched and tempered or air cooled and tempered armour steel plate having a thickness of 5-7 mm, a strength coefficient ($\sigma_0$) of higher than 2500 MPa, a flow parameter (P) of higher than 8.0, a manganese content of 2.9% to 3.6% by weight of manganese, and retained austenite at a volume fraction of 6% to 20%, and an alloy composition of: 0.42% to 0.46% of carbon, by weight, and 1.0-1.3% of silicon;
3.0-3.6% nickel;
1.2-1.4% chromium;
0.55-0.70% molybdenum,
with the balance being iron.

11. A quenched and tempered or air cooled and tempered armour steel plate having a thickness of 8-10 mm, a strength coefficient ($\sigma_0$) of higher than 2500 MPa, a flow parameter (P) of higher than 8.0, a manganese content of 2.9% to 3.6% by weight of manganese, and retained austenite at a volume fraction of 6% to 20%, and an alloy composition of: 0.29% to 0.33% of carbon, by weight, and 0.8-1.1% of silicon;
3.0-3.6% nickel;
1.0-1.2% chromium;
0.55-0.70% molybdenum,
with the balance being iron.

12. A method of producing martensitic armour steel alloy having a retained austenite at a volume fraction of 6% to 20%, the method comprising the steps of subjecting a steel alloy, which comprises a manganese content of 2.9% to 3.6% by weight of manganese; a carbon content of 0.29% to 0.46% by weight of carbon, silicon, nickel, chromium, molybdenum and iron to hot-rolling from a reheating temperature of between 1000° C. and 1250° C., finish rolling in the order of 900° C. or lower to achieve a fine austenite grain size, and then air cooling the alloy to room temperature.

13. The method according to claim 12 wherein the method includes the intermediate step, after hot-rolling, of subjecting the steel alloy to an austenisation heat treatment step at a temperature of 800° C.-900° C., after which the alloy is air cooled or quenched.

14. The method according to claim 12 where the method includes the optional heat treatment step of tempering after the steel is cooled, whether through air-cooling or quenching.

15. Body armour inserts and as-rolled thin armour plate comprising the martensitic armour steel alloy according to claim 1 above.

16. The martensitic armour steel alloy according to claim 1 wherein the alloy has a flow parameter (P) of higher than 18.0.

17. The martensitic armour steel alloy according to claim 1 wherein the alloy is produced at a martensite-start temperature ($M_s$) of 114° C. to 219° C.

18. The armour steel plate according to claim 8 wherein the plate has a thickness of 8 mm.

19. The armour steel plate according to claim 9 wherein the plate has a thickness of 7 mm.

20. The armour steel plate according to claim 10 wherein the plate has a thickness of 6 mm.

21. The armour steel plate according to claim 11 wherein the plate has a thickness of 9 mm.

22. The martensitic armour steel alloy according to claim 12 wherein the alloy is produced at a martensite-start temperature ($M_s$) of 114° C. to 219° C.

23. A quenched and tempered or air cooled and tempered armour steel plate having a thickness of 5-7 mm, and the following composition, by weight:

2.6-2.9% of manganese;
0.42-0.46% of carbon;
1.0-1.3% of silicon;
3.0-3.6% nickel;
1.2-1.4% chromium;
0.55-0.70% molybdenum,
with the balance being iron.

24. The armour steel plate according to claim 22 wherein the plate has a thickness of 6 mm.

* * * * *